United States Patent [19]

Yonezawa et al.

[11] Patent Number: 5,050,482

[45] Date of Patent: Sep. 24, 1991

[54] APPARATUS FOR DRIVING PISTON BY FLUID PRESSURE

[75] Inventors: Keitaro Yonezawa; Akihiro Nakata, both of Kobe, Japan

[73] Assignee: Kabushiki Kaisha KOSMEK, Kobe, Japan

[21] Appl. No.: 647,253

[22] Filed: Jan. 29, 1991

[30] Foreign Application Priority Data

Jan. 31, 1990 [JP] Japan ..... 2-23065

[51] Int. Cl.[5] ..... F01L 25/02

[52] U.S. Cl. ..... 91/304; 91/313; 91/307; 417/392; 417/398; 417/401; 417/402

[58] Field of Search ..... 417/392, 398, 401, 402; 91/287, 304, 307, 313; 137/625.6

[56] References Cited

U.S. PATENT DOCUMENTS

| | | | |
|---|---|---|---|
| 485,787 | 11/1892 | Craig | 91/307 |
| 2,361,757 | 10/1944 | Fink | 91/313 X |
| 2,745,387 | 5/1956 | Dinkelkamp | 91/287 |
| 3,019,773 | 2/1962 | Meeker | 91/313 X |
| 3,071,118 | 1/1963 | Wilden | 91/313 |
| 3,101,030 | 8/1963 | Hyatt et al. | 91/313 X |
| 3,272,081 | 9/1966 | Vedder et al. | 91/313 X |
| 3,489,100 | 1/1970 | Hill | 91/307 |
| 3,609,061 | 9/1971 | Peoples | 417/401 X |
| 3,963,383 | 6/1976 | Hill | 91/306 X |
| 4,042,311 | 8/1977 | Yonezawa | 417/401 |
| 4,645,431 | 2/1987 | Spencer et al. | 417/401 |
| 4,812,109 | 3/1989 | Yonezawa | 417/401 |
| 4,971,531 | 11/1990 | Aikioniemi | 417/401 |
| 4,993,924 | 2/1991 | Mukumoto et al. | 417/402 |

FOREIGN PATENT DOCUMENTS

| | | | |
|---|---|---|---|
| 441872 | 1/1936 | United Kingdom | 417/402 |

*Primary Examiner*—Edward K. Look
*Assistant Examiner*—Todd Mattingly
*Attorney, Agent, or Firm*—Foley & Lardner

[57] ABSTRACT

An apparatus for driving a piston by fluid pressure in which a piston (8) is reciprocated upward and downward by supplying and discharging pressure fluid to and from an actuation chamber (9) disposed in a cylinder (7) through a pilot valve (18) and a fluid pressure supply-discharge valve (13). Above a supply-discharge valve member (30) of the supply-discharge valve (13) there is provided a cylinder chamber (70*a*), into which a pilot valve casing (71) is inserted so as to hermetically slide up and down. The fluid pressure in the discharge actuation chamber (35) disposed above the supply-discharge valve member (30) allows the pilot valve casing (71) to ascend against a return spring (73).

7 Claims, 2 Drawing Sheets

APPARATUS FOR DRIVING PISTON BY FLUID PRESSURE

BACKGROUND OF THE INVENTION

1. Field of the Invention

The present invention relates to an engine of such a type that a piston is reciprocatingly driven by fluid pressure such as pneumatic or hydraulic pressure.

2. Prior Art

The present invention provides an art that is an improvement of such an apparatus as disclosed in U.S. Pat. No. 4,812,109 (Yonezawa) one of the present inventors has previously proposed.

The following description is directed to objects of the improvement in the above prior art, and more particularly to the constructions and problems thereof. Throughout this description of the prior art, component members which correspond to their counterparts in FIG. 1 of the above-mentioned U.S. Pat. No. 4,812,109 are referenced by the same numerals, here parenthesized, as in the FIG. 1.

The prior art mentioned above is so constructed that the pilot valve casing of a pilot valve (18) is secured at its upper portion to a supply-discharge valve casing (29) and that a pilot valve seat (48) formed of an O-ring is received by the lower portion of a support cylinder (49) provided downwardly protrusively from the pilot valve casing.

The conventional construction as shown above is advantageous in that in the descending process of the supply-discharge valve member (30), the back pressure of the valve member (30) can rapidly be reduced on its way of descent, whereby the engine can be prevented from being stopped in operation even when the piston (8) is driven at a very low speed. However, there has been a problem that the engine may be stopped operating when the piston (8) is driven at a still lower speed than above.

This problem can be attributed to the following reason:

When the piston (8) is actuated to descend toward its bottom dead point at an extremely low speed, the resulting speed at which a pilot valve member (46) secured to the piston (8) leaves apart from the pilot valve seat (48) also becomes lower to a great extent. Due to this, the pressure fluid drawn into a discharge actuation chamber (35) from a supply actuation chamber (33) is reduced in pressure through a narrow clearance between the valve member (46) and the valve seat (48), pressurizing the inside of the discharge actuation chamber (35) only at an extremely low speed. This causes the descending speed of the supply-discharge valve member (30) to become lower in the first half of its descent because of a small amount of force for pushing down the valve member when it has started to descend. As a result, the pressure fluid in the fluid pressure actuation chamber (9) is permitted to escape from an operation chamber (32) to a discharge chamber (34) before the back pressure of the supply-discharge valve member (30) turns to a smaller value, thus the supply-discharge valve member (30) being stopped on its way of descent, with the engine stopped operating.

SUMMARY OF THE INVENTION

Accordingly, it is an object of the present invention to prevent the engine from stopping when it is driven at an extremely low speed.

The present invention is characterized by the following improvements added to the above-mentioned prior art in order to achieve the foregoing object.

For example, as shown in FIGS. 1 and 2, a cylinder chamber 70*a* is formed at an upper portion of the supply-discharge valve casing 29, wherein the pilot valve casing 71 is inserted into the cylinder chamber 70*a* so as to be hermetically slidable up and down; and a pressure-receiving actuation chamber 70*b* is formed so as to confront the bottom face of the pilot valve casing 71, wherein the pressure-receiving chamber 70*b* is communicated with the discharge actuation chamber 35 while the pilot valve casing 71 is urged downwardly by a return spring 73.

The engine for driving a piston by fluid pressure according to the present invention operates in the following manner, as shown in FIG. 1.

In the case where the piston 8 is driven to descend at an extremely low speed for any reason, when the pilot-pressure valve member 46 is turned, along with the descent of the piston 8, from the state in which it is at the top dead point thereof, as depicted by solid lines in the left half of the figure, toward the state in which it is at the bottom dead point, as depicted by two-dot chain lines in the same left half of the figure, first the outer circumferential face of the pilot-pressure valve member 46 leaves apart from the inner circumferential face 48*a* of the pilot-pressure valve seat 48 at an extremely low speed, as depicted by dash-and-dot lines. Then, the pressure fluid in the supply actuation chamber 33 is permitted to pass through the valve-opening clearance between the valve member 46 and the valve seat 48, and thus drawn into the discharge actuation chamber 35 and pressure-receiving actuation chamber 70*b*, pressurizing both the chambers 35 and 70*b* at an extremely low speed.

At a time point when the above-mentioned pressure-receiving actuation chamber 70*b* is internally pressurized to a predetermined pressure, the internal pressure thereof causes the pilot valve casing 71 to be driven to ascend agaist the urging force of a second return spring 73, as depicted by solid lines in the right half of the figure, while the pilot-pressure valve seat 48 is pushed up along with the ascent of the pilot valve casing 71, leaving apart from the pilot-pressure valve member 46 rapidly.

As a result, the pressure fluid in the supply actuation chamber 33 is drawn into the discharge actuation chamber 35 through the resulting larger valve-opening clearance, pressurizing the discharge actuation chamber 35 rapidly until the pressure pushes down the supply-discharge valve member 30 with great force to descend it at a very high speed, with the result that the valve member 30 is turned to the discharge position Y as shown in the right half of the figure.

Now that the actuation chamber 9 communicates with a discharge port 15 through the operation chamber 32 and the discharge chamber 34, the piston 8 starts its returning up-stroke by virtue of the urging force of a first return spring 11.

As described above, since the supply-discharge valve member 30, even if the piston 8 is driven to descend at an extremely low speed, is pushed down with great force, it is prevented from stopping on its way of descent. Accordingly, the engine is prevented from being stopped in its operation.

BRIEF DESCRIPTION OF THE DRAWINGS

FIGS. 1 and 2 illustrate an embodiment of the present invention, wherein:

FIG. 1 is a schematic view for explaining its operation; and

FIG. 2 is a longitudinal sectional view of a booster pump apparatus to which an engine according to the present invention is applied.

DESCRIPTION OF THE PREFERRED EMBODIMENT

Now an embodiment of the present invention is described below with reference to the accompanying drawings.

Figure 2:
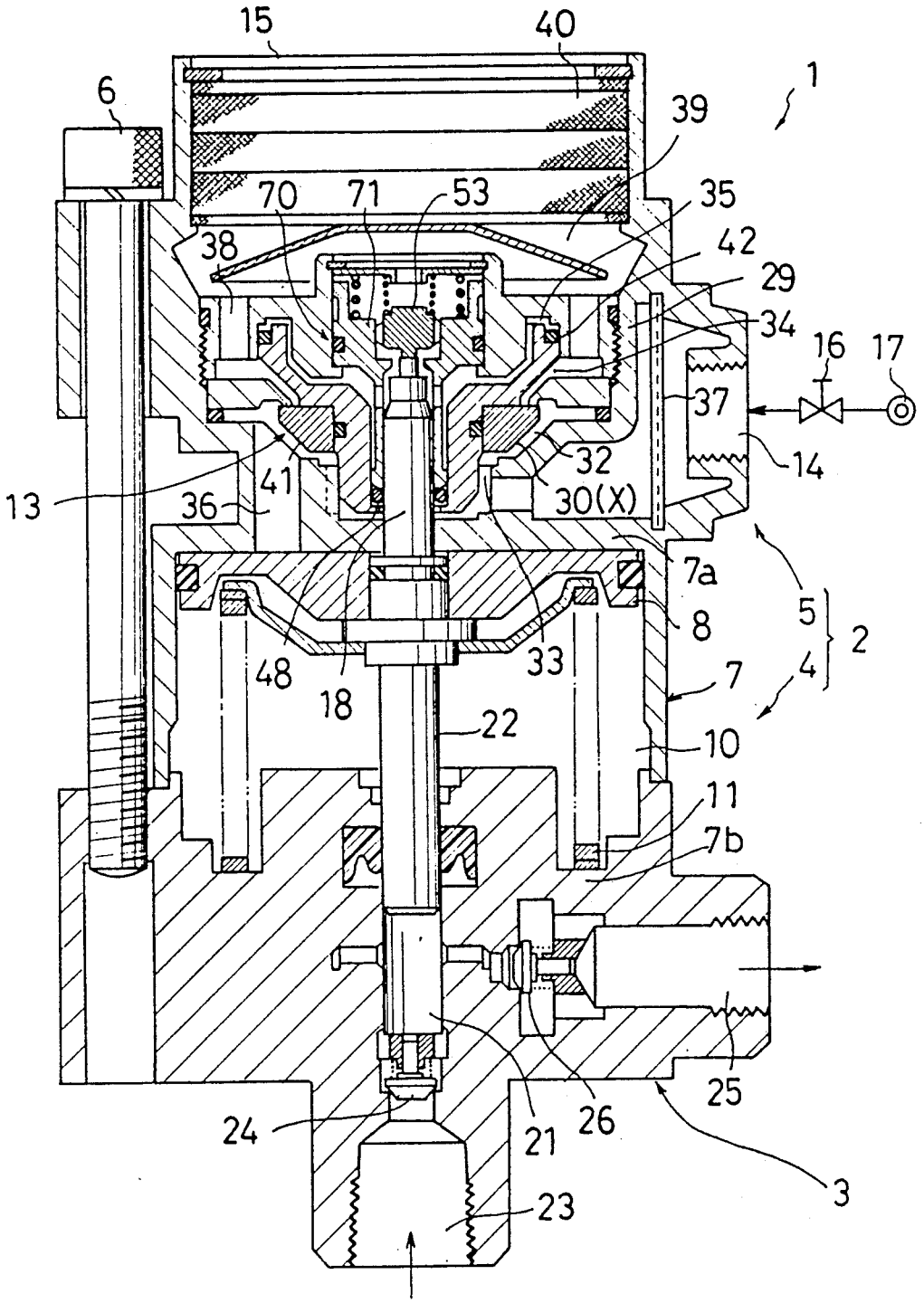

In FIG. 2, reference numeral 1 denotes a booster pump apparatus, which comprises an engine 2 that operates pneumatically (by fluid pressure) to render linear reciprocating movement of a piston by means of compressed air, and a plunger-type hydraulic pump 3 driven by the engine 2 to feed out a high-pressure oil.

The engine 2 includes main members 4 thereof that convert the pressure energy of compressed air into power, to or from which main members 4 compressed air is supplied or discharged through fluid pressure supply-discharge means 5. These main members 4 and fluid pressure supply-discharge means 5 are tightly secured to the hydraulic pump 3 with a plurality of tie rods 6.

The main members 4 of the engine 2 are so constructed as to be returned by a single-acting spring. More specifically, a piston 8 is inserted into a cylinder 7 so that the piston 8 may slide along the cylinder 7 in an air-tight manner. An actuation chamber 9 is formed between the upper wall 7*a* of the cylinder 7 and the piston 8 (see FIG. 1), while a spring chamber 10 is formed between the lower wall 7*b* of the cylinder 7 and the bottom of the piston 8. To the spring chamber 10 is mounted a first return spring 11. The piston 8 is driven toward its bottom dead point against the urging force of the first return spring 11 when compressed air is supplied to the actuation chamber 9. The piston 8 is driven toward its top dead point by the urging force of the first return spring 11, in turn, when compressed air is discharged from the actuation chamber 9.

The supply-discharge means 5 includes a fluid pressure supply-discharge valve 13, through which the actuation chamber 9 is connected switchably either to a supply port 14 or to a discharge port 15. The supply port 14 is connected to a pneumatic pressure supply source (fluid pressure supply source) 17 through a fluid pressure supply valve 16. The discharge port 15 opens outside. The pilot valve 18 allows the supply-discharge valve 13 to take the supply position X and the discharge position Y switchably (see FIG. 1).

The plunger-type hydraulic pump 3 is so constructed that a plunger 22 is inserted into a pump chamber 21 so as to be vertically slidable along with the pump chamber 21 in an oil-tight manner and the plunger 22 is connected to the piston 8. When the piston 8 is actuated to descend, the plunger 22 moves downward into the pump chamber 21, so that the internal pressure in the pump chamber 21 rises and a discharge valve 26 is opened. As a result, the hydraulic oil in the pump chamber 21 is discharged from a discharge port 25. On the other hand, when the piston 8 is actuated upward to return, the plunger 22 retreats from the pump chamber 21, with the result that the internal pressure in the pump chamber 21 drops and a suction valve 24 is opened, thereby hydraulic oil being drawn into the pump chamber 21 from a suction port 23. Thus, the pump 3 feeds a high-pressure hydraulic oil by repeating the steps described above.

Figure 1:
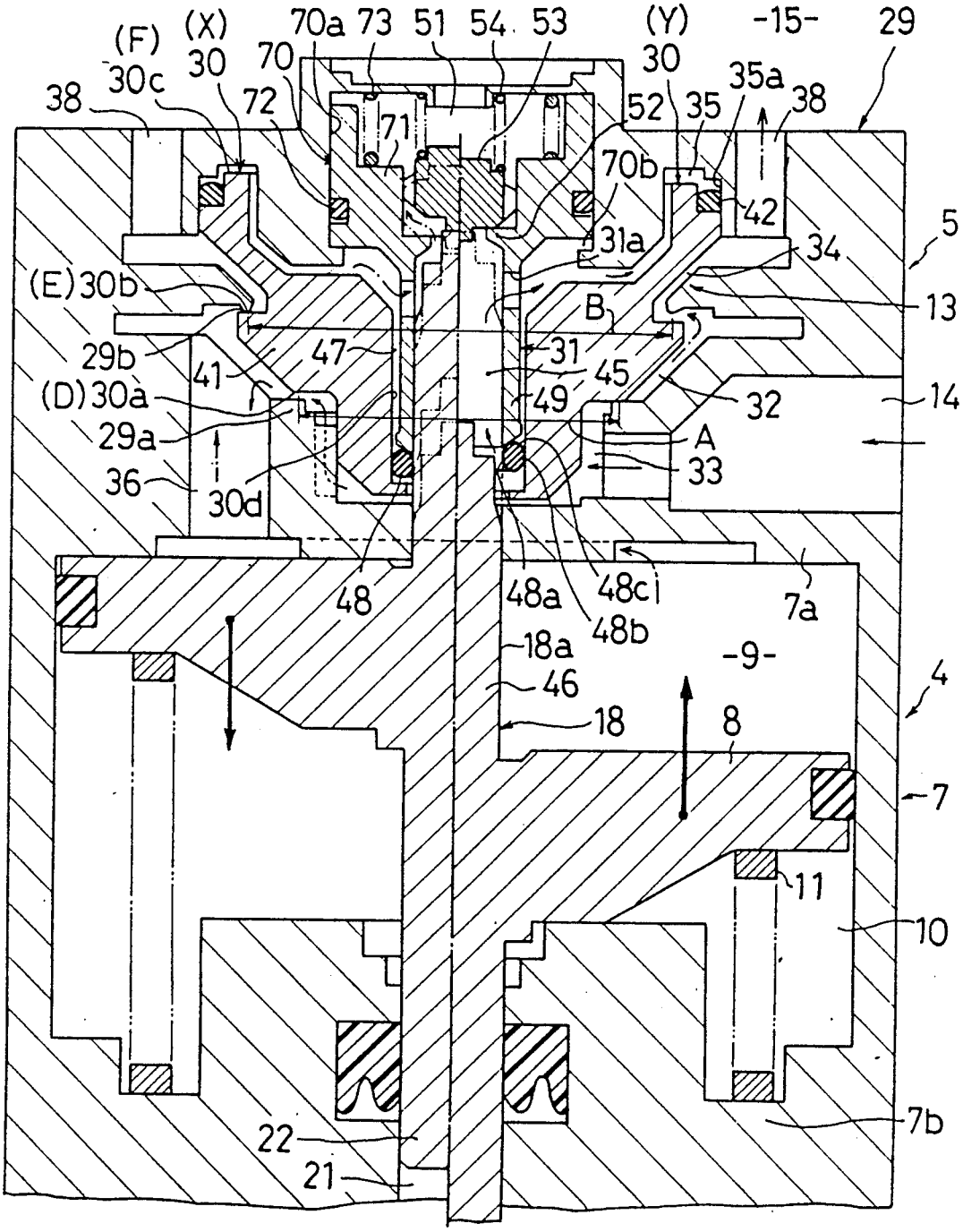

The detailed description of the supply-discharge means 5 provided to the booster pump 1 is made hereinafter with reference primarily to FIG. 1. The left half of FIG. 1 and FIG. 2 show the piston 8 which has started to descend, while the right half of FIG. 1 shows the piston 8 which has started to ascend.

First referring to the supply-discharge valve 13, it is so constructed that a cylindrical supply-discharge valve member 30 is inserted into a supply-discharge valve casing 29 disposed above the cylinder 7. The supply-discharge valve member 30 turns to the supply position X when it is pushed upward, as illustrated in the left half of the figure, while it turns to the discharge position Y when pushed downward, as illustrated in the right half. Within the supply-discharge valve casing 29, there are formed a supply actuation chamber 33 below the supply-discharge valve member 30, an operation chamber 32 on the lower portion of the outer circumferential face of the valve member 30, a discharge chamber 34 on the upper portion of the same, and a discharge actuation chamber 35 thereabove. In the supply-discharge valve member 30 there is further provided a discharge actuation chamber inlet hole 30*d* so as to extend vertically.

The operation chamber 32 communicates with the actuation chamber 9 through a supply-discharge hole 36. The supply port 14 communicates with the discharge port 15 through a filter 37, the supply actuation chamber 33, inside of a supply-side valve seat 29*a*, the operation chamber 32, inside of a discharge side valve seat 29*b*, the discharge chamber 34, a discharge hole 38, and an outlet chamber 39, in this order. The outlet chamber 39 is internally provided with a silencer 40. The discharge actuation chamber 35 communicates with the supply actuation chamber 33 through the discharge actuation chamber inlet hole 30*d*. The discharge actuation chamber 35 is partitioned from the discharge chamber 34 by an O-ring 42 mounted between the outer circumferential face 35*a* of the chamber 35 and the circumferential face of the supply-discharge valve member 30.

The supply-discharge valve member 30 is provided with a valve cylinder 41 which externally fits to the valve main portion thereof airtightly (see FIG. 2). A supply actuation valve-face 30*a* which confronts the supply actuation chamber 33 is formed on the bottom of the valve cylinder 41, while a discharge-side valve-face 30*b* which confronts the discharge chamber 34 is formed on the top of the valve cylinder 41. Since the above-mentioned valve cylinder 41 is arranged as an independent part as shown above, the two upper and lower valve faces that make sealing contact with the foregoing valve seats 29*a* and 29*b* are more easily precision-machined to the two pressure-receiving faces 30*a* and 30*b*, thus enhancing the sealing performance of the supply-discharge valve member 30. Moreover, the discharge actuation valve-face 30*c* is formed on the top of the supply-discharge valve member 30 so as to confront the discharge actuation chamber 35. The outer diameter A of the supply actuation valve-face 30*a*, the outer diameter B of the discharge-side valve-face 30*b*, and that of the discharge actuation valve-face 30*c* are each surpassed by their following counterpart in this order, in their values. Accordingly, it follows that the pressure-receiving cross-sectional area D of the supply actuation valve-face 30*a* is smaller than the pressure-receiving cross-sectional area E of the discharge-side valve-face 30*b*, which area E is smaller than the pressure-receiving cross-sectional area F of the discharge actuation valve-face 30*c*.

When the supply-discharge valve member 30 is pushed up to its supply position X, as shown in the left half of FIG. 1, the supply actuation valve-face 30*a* leaves apart from the supply-side valve seat 29*a*, thereby making the actuation valve chamber 33 communicated with the operation chamber 32, while the discharge-side valve-face 30*b* is brought into contact with the discharge-side valve seat 29*b*, thereby sealing the space between the operation chamber 32 and the discharge chamber 34. On the other hand, when the supply-discharge valve member 30 is pushed down to its discharge position Y, as shown in the right half of FIG. 1, the supply actuation valve-face 30*a* is brought into contact with the supply-side valve seat 29*a*, thereby sealing the space between the supply actuation chamber 33 and the operation chamber 32, while the discharge-side valve-face 30*b* leaves apart from the discharge-side valve seat 29*b*, thereby making the operation chamber 32 communicated with the discharge chamber 34.

The pilot valve 18 is so operated as to allow the fluid pressure supply-discharge valve 13 to take its fluid-pressure supply position X or discharge position Y switchably, and including a piston-type pilot valve casing 71, a pilot-pressure valve member 46, a pilot-pressure valve seat 48, a pressure-relief valve member 53, and a pressure-relief valve seat 52.

More specifically, within an upper portion of the supply-discharge valve casing 29 there is formed a cylinder chamber 70*a* for a pilot fluid-pressure clinder 70. The pilot valve casing 71 is inserted into the cylinder chamber 70*a* through an O-ring 72 so as to be airtightly slidable upward and downward. A pressure-receiving actuation chamber 70*b* so formed as to confront the bottom face of the pilot valve casing 71 communicates with the discharge actuation chamber 35. The pilot valve casing 71 can be driven upward by the internal pressure of the pressure-receiving actuation chamber 70*b* against the urging force of a return spring 73.

A support cylinder 31, which protrudes downwardly from the pilot valve casing 71, is inserted into the discharge actuation chamber inlet hole 30*d* of the supply-discharge valve member 30 with a clearance 47 disposed therebetween. A ring-shaped pilot-pressure valve seat 48 comprising an O-ring is mounted to a lower portion 49 of the support cylinder 31 from below. The inner circumferential face 48*a* of the pilot-pressure valve seat 48 is allowed to make sealing contact with the outer circumferential face of the pilot-pressure valve member 46, while the outer circumferential face 48*b* thereof is allowed to make sealing contact with the discharge actuation chamber inlet hole 30*d*, and the upper face 48*c* thereof is to be received by the lower portion 49 of the support cylinder 31. A pressure-relief valve seat 52 is provided within the upper portion of the pilot valve casing 71, to which valve seat 52 the pressure-relief valve member 53 is urged downwardly by a valve-closing spring 54 so as to close the valve. A pressure-relief port 51 disposed above the pressure-relief valve member 53 communicates with the discharge port 15. The pilot-pressure valve member 46 is fixed to the piston 8. The supply port 14 communicates with the discharge actuation chamber 35 from between the pilot-pressure valve member 46 and the pilot-pressure valve seat 48 within the discharge actuation chamber inlet hole 30*d* through the pilot valve chamber 45 and a lateral through-hole 31*a* of the support cylinder 31.

The pilot valve 18 operates in such a manner as described below.

When the pilot valve member 46 is actuated to descend along with the piston 8 from the position in which the valve member 46 is at its top dead point, as depicted by solid lines in the left half of the figure, toward the position in which it is at the bottom dead point, as depicted by two-dot chain lines in the same left half of the figure, first the pressure-relief valve member 53 is seated to the pressure-relief valve seat 52 to close the pressure-relief port 51, as depicted by the upper dash-and-dot lines. Then the outer circumferential face of the pilot-pressure valve member 46 starts to leave apart from the inner circumferential face 48*a* of the pilot-pressure valve seat 48, as depicted by the lower dash-and-dot lines. As a result, the pressure fluid in the supply actuation chamber 33 is permitted to pass through the clearance between the valve member 46 and the valve seat 48, pilot valve chamber 45, and through-hole 31*a*, thereby drawn into the discharge actuation chamber 35 and the pressure-receiving actuation chamber 70*b*.

Owing to the internal pressure of the pressure-receiving actuation chamber 70*b*, as depicted by solid lines in the right half of the figure, the pilot valve casing 71 is driven to ascend against the urging force of both the springs 73 and 54, and the pilot-pressure valve seat 48 is abruptly pushed up so as to leave apart from the pilot-pressure valve member 46 by the pressure of the supply actuation chamber 33. Subsequently, the discharge actuation chamber 35 is abruptly pressurized so that the supply-discharge valve member 30 is pushed down with great force until it is turned to the discharge position Y in the right half of the figure. As a result, the actuation chamber 9 is communicated with the discharge port 15 through the supply-discharge hole 36, operation chamber 32, discharge chamber 34, and discharge hole 38, thereby the piston 8 starting to ascend. In this case, to push down the supply-discharge valve member 30, as in the conventional counterpart, the back pressure is diminished on its descending way from the force applied to the pressure-receiving cross-sectional area E of the discharge-side valve-face 30*b* down to another applied to the like area D of the supply actuation valve-face 30*a*. Accordingly, the supply-discharge valve member 30 is increased in its descending speed on its way of descent, thus further ensuring that the supply-discharge valve member 30 is turned to the discharge position Y.

On the other hand, when the pilot-pressure valve member 46 is actuated to ascend along with the piston 8 from the position in which it is at the bottom dead point, as depicted by the solid lines in the right half of the figure, toward the position in which it is at the top dead point, as shown by the two-dot chain lines in the same right half of the figure, first the outer circumferential face of the pilot-pressure valve member 46 makes sealing contact with the inner circumferential face 48*a* of the pilot-pressure valve seat 48. Then the pressure-relief valve member 53 is made to leave apart from the pressure-relief valve seat 52 against the valve-closing spring 54, so that the discharge actuation chamber 35 is communicated with the discharge port 15 through the through-hole 31*a* of the support cylinder 31, the valve-opening clearance of 52 and 53, and the pressure relief port 51. Accordingly, the supply-discharge valve member 30 is pushed up owing to the pressure difference between the upper and lower spaces thereof, thus turning to its supply position X, as shown in the left half of the figure. The actuation chamber 9 is, at this time, communicated with the supply port 14 through the supply-discharge hole 36, operation chamber 32, and supply actuation chamber 33, thereby the piston 8 starting to descend.

In the above-described embodiment, the pilot-pressure valve seat 48 of the pilot valve 18 may also be mounted to the inner circumferential face of the lower portion 49 of the support cylinder 31 other than mounted to the bottom face thereof and moreover the O-ring may be replaced with another type of packing.

Further, the engine 2, instead of being actuated by pneumatic pressure, may also be actuated by other type of gas such as nitrogen or by hydraulic fluid. Although the hydraulic pump 3 is driven by the engine 2 in this embodiment, any other apparatus may substitute the hydraulic pump 3 only if it is capable of converting linear motion into mechanical work.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An apparatus for driving a piston by fluid pressure, wherein:

a main member (4) of the apparatus, being of a single-acting spring returning type, is so constructed that a piston (8) inserted into a cylinder (7) is driven to descend by fluid pressure in an actuation chamber (9);

a fluid pressure supply-discharge valve (13) allows pressure fluid to be supplied to or discharged from the actuation chamber (9), being provided with a supply-discharge valve casing (29) disposed above the cylinder (7) and a supply-discharge valve member (30) inserted into the supply-discharge valve casing (29) so as to be slidable up and down;

the supply-discharge valve member (30) can be turned switchably between the upper supply position (X) by the pressure fluid in a supply actuation chamber (33) formed therebelow and the lower discharge position (Y) by the pressure fluid in a discharge actuation chamber (35) formed thereabove, the pressure-receiving cross-sectional area (F) of a discharge actuation valve-face (30*c*) which confronts the discharge actuation chamber (35) being set to a value greater than the pressure-receiving cross-sectional area (D) of a supply actuation valve-face (30*a*) which confronts the supply actuation chamber (33); and a pilot valve (18) allows pressure fluid to be supplied to or discharged from the discharge actuation chamber (35), being provided with a pilot valve casing (71) supported by the supply-discharge valve casing 29, a pilot-pressure valve member (46) linked with the piston (8), and a pilot-pressure valve seat (48) that makes sealing contact with the valve member (46), the improvement comprising:

a cylinder chamber (70*a*) disposed above the supply-discharge valve member (30);

the pilot valve casing (71), having its bottom face, inserted into the cylinder chamber (70*a*) so as to be hermetically slidable up and down;

a pressure-receiving actuation chamber (70*b*) formed so as to confront the bottom face of the pilot valve casing (71) and communicated with the discharge actuation chamber (35); and a return spring (73) adapted to urge the pilot valve casing (71) downwardly.

2. An apparatus for driving a piston by fluid pressure wherein:

a main member (4) of the apparatus having a supply port (14) and a discharge port (15) allows a piston (8) to be driven toward the bottom dead point thereof by fluid pressure in an actuation chamber (9) or to be driven toward the top dead point thereof by a first return spring (11);

a fluid pressure supply-discharge valve (13) disposed above the cylinder (7) allows the actuation chamber (9) to be switchably connected with a supply port (14) and a discharge port (15), comprising:

a supply-discharge valve casing (29) provided with a supply-side valve seat (29*a*) and a discharge-side valve seat (29*b*);

a supply-discharge valve member (30) inserted into the supply-discharge valve casing (29) so as to be slidable up and down, switchable between the upper supply position (X) and the lower discharge position (Y) thereof, wherein:

there are formed a supply actuation chamber (33) below the supply-discharge valve member (30), an operation chamber (32) on the lower portion of the outer circumferential face of the valve member (30), a discharge chamber (34) on the upper portion of the same, and a discharge actuation chamber (35) thereabove, respectively, and further in the supply-discharge valve member (30) there is formed a discharge actuation chamber inlet hole (30*d*) which extends vertically;

a supply actuation valve-face (30*a*) and a discharge actuation valve-face (30*c*) are formed so as to confront the supply actuation chamber (33) and the discharge actuation chamber (35), respectively, the pressure-receiving cross-sectional area (F) of the discharge actuation valve-face (30*c*) being set to a value greater than that of the pressure-receiving cross-sectional area (D) of the supply actuation valve-face (30*a*); and the operation chamber (32) communicates with the actuation chamber (9), the supply port (14) communicates with the discharge port (15) through the supply actuation chamber (33), inside of the supply-side valve seat (29*a*), the operation chamber (32), inside of the discharge-side valve seat (29*b*), and the discharge chamber (34) in this order, and the discharge actuation chamber (35) communicates with the supply actuation chamber (33) through the discharge actuation chamber inlet hole (30*d*); and a pilot valve (18) which operates the fluid pressure supply-discharge valve (13) switchably between the supply position (X) and the discharge position (Y) thereof, comprising:

a pilot valve casing (71) having a lower portion (49) inserted into the discharge actuation chamber inlet hole (30*d*) and an upper portion supported by the supply-discharge valve casing (29);

a pilot-pressure valve seat (48) shaped into a ring and disposed within the lower portion (49) of the pilot valve casing (71);

a pressure-relief valve seat (52) and a pressure-relief valve member (53) disposed within the upper portion of the pilot valve casing (71);

a valve-closing spring (54) adapted to urge the pressure-relief valve member (53) downwardly to the pressure-relief valve seat (52);

a pilot-pressure valve member (46) linked with the piston (8) so as to be movable along therewith, being fitted to the pilot-pressure valve seat (48) so as to close the valve and to be slidable up and down, wherein:

within the discharge actuation chamber inlet hole (30*d*), the supply port (14) communicates with the discharge actuation chamber (35) through the clearance between the pilot-pressure valve member (46) and the pilot-pressure valve seat (48), the improvement comprising:

a cylinder chamber (70*a*) formed at an upper portion of the supply-discharge valve casing (29);

the pilot valve casing (71) having a bottom face and inserted into the cylinder chamber (70*a*) so as to be hermetically slidable up and down; and a pressure-receiving actuation chamber (70*b*) formed so as to confront the bottom face of the pilot valve casing (71) and to communicate with the discharge actuation chamber (35); and a second return spring (73) adapted to urge the pilot valve casing (71) downwardly.

3. An apparatus for driving a piston by fluid pressure as claimed in claim 1 or claim 2, wherein the pilot-pressure valve seat (48) is provided independently of the pilot valve casing (71).

4. An apparatus for driving a piston by fluid pressure as claimed in claim 1 or claim 2, wherein the supply-discharge valve member (30) includes a main member thereof and a valve cylinder (41) externally fitted thereto in an hermetical manner.

5. An apparatus for driving a piston by fluid pressure as claimed in claim 2, wherein the supply-discharge valve member (30) is provided with a discharge-side valve-face (30*b*) which confronts the operation chamber (32), the pressure-receiving cross-sectional area (E) of the discharge-side valve-face (30*b*) being set to a value intermediate between the pressure-receiving cross-sectional area (D) of the supply actuation valve-face (30*a*) and the pressure-receiving cross-sectional area (F) of the discharge actuation valve-face (30*c*).

6. An apparatus for driving a piston by fluid pressure as claimed in claim 1 or claim 2, wherein the piston (8) is driven by the pressure of compressed air.

7. An apparatus for driving a piston by fluid pressure as claimed in claim 1 or claim 2, wherein a plunger (22) of a hydraulic pump (3) is linked with the piston (8).

* * * * *